US006827068B1

(12) United States Patent
Sakata et al.

(10) Patent No.: US 6,827,068 B1
(45) Date of Patent: Dec. 7, 2004

(54) OIL SEAL AND DRAIN STRUCTURE FOR ENGINE

(75) Inventors: Shigekazu Sakata, Chapel Hill, NC (US); Brian Doklovic, Hillsborough, NC (US); Shinji Katayama, Chapel Hill, NC (US); Hiroshi Hojo, Moroyama (JP); Tetsuya Kobayashi, Chapel Hill, NC (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/783,171

(22) Filed: Feb. 20, 2004

Related U.S. Application Data

(60) Provisional application No. 60/507,570, filed on Oct. 1, 2003.

(51) Int. Cl.[7] ..... F01M 3/00

(52) U.S. Cl. ..... 123/572; 123/41.86

(58) Field of Search ..... 123/572–574, 123/41.86

(56) References Cited

U.S. PATENT DOCUMENTS 4,922,881 A * 5/1990 Tamba et al. ..... 123/572
5,261,380 A * 11/1993 Romano ..... 123/573
5,937,836 A 8/1999 Yonezawa et al.
6,109,250 A * 8/2000 Haberlein et al. ..... 123/572

* cited by examiner

*Primary Examiner*—Marguerite McMahon
(74) *Attorney, Agent, or Firm*—Rankin, Hill, Porter & Clark LLP; Christen Millard

(57) ABSTRACT

A lubrication and breather system for an engine that is generally adapted for use as either a vertically-oriented crankshaft-type engine or a horizontally-oriented crankshaft-type engine. The crankcase has first and second bearing bosses supporting first and second journal portions of the crankshaft. The second bearing boss lies above the first bearing boss when the engine is of the vertical-type. The system includes a cap that is secured over the second bearing boss and cooperates with the second bearing boss to define an annular chamber for receiving splashed oil produced in the crankcase. The cap has a plurality of ribs formed thereon that reduce an amount of oil, which is entrained in the blow-by gas, sent from the annular chamber to the breather chamber. The second bearing block includes an oil feed hole, a plurality of oil sumps, and a plurality of oil return holes, with the oil return holes being of relatively smaller size. Each of the oil sumps is associated with one oil return hole. A volume of oil ordinarily remains in the oil sump to limit entry of blow-by gases into the annular chamber via the oil return holes.

15 Claims, 8 Drawing Sheets

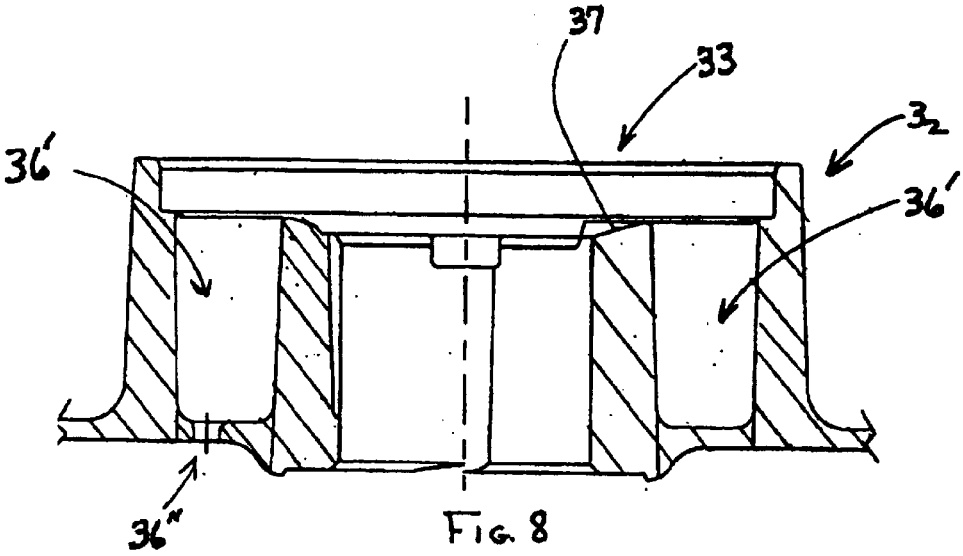
FIG. 8
FIG. 9
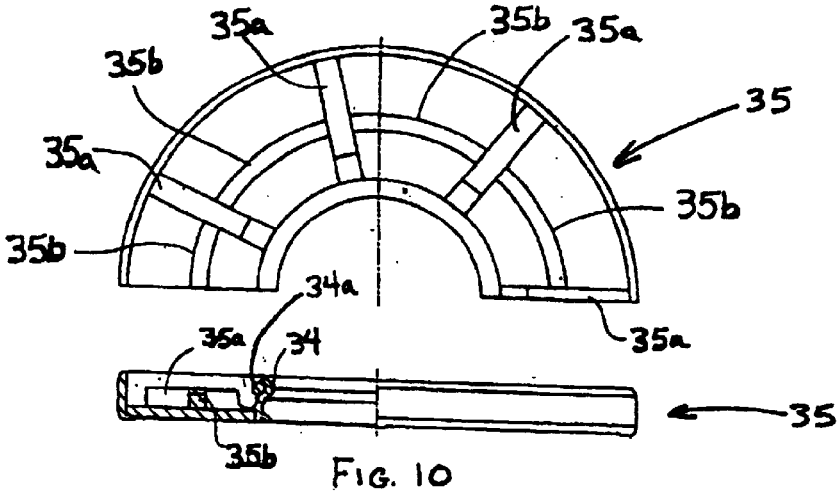
FIG. 10

OIL SEAL AND DRAIN STRUCTURE FOR ENGINE

BACKGROUND OF THE INVENTION

1. Field of the Invention

The present invention generally relates to a lubricating system for use in a horizontal-type engine or a vertical-type engine including a crankcase and a cylinder block and, more specifically, to an improved oil seal and drain structure in such a lubricating system.

2. Description of the Related Art

Prior art type engines include a horizontal-type in which a crankshaft is disposed horizontally, and a vertical-type in which a crankshaft is disposed vertically. In the conventional engines, the crankcase and the cylinder block are different for each of the types, because of different conditions of the arrangement of a discharge passage for a blow-by gas produced in the crankcase and a return passage for oil separated from the blow-by gas and returned to the crankcase.

The different construction of the crankcase and the cylinder block in each of the types is inconvenient for providing a mass-produced engine, resulting in higher cost.

U.S. Pat. No. 5,937,836, the disclosure of which is expressly incorporated herein in its entirety, provides a solution to the above referenced problem, and presents an engine that is adapted for both horizontally and vertically-oriented crankshafts. The lubrication system of the '836 patent has been found to work quite well in engines having either horizontally or vertically-oriented crankshafts. However, with the structure of the '836 patent, there is presented a potential problem that, depending upon the engine displacement size and the configuration of the second bearing boss, there may be an excessive amount of oil communicated from the crankcase into the breather chamber when the crankshaft is vertically-oriented. While the breather chamber includes means to filter the oil out of the blow-by gas, the quantity of oil may be so great as to overwhelm the filtering means and therefore cause too much oil to be conveyed with the blow-by gas into the air cleaner of the engine intake system, leading to engine performance issues.

Accordingly, there exists a need in the art for an improved lubrication system for an engine having a vertically oriented crankshaft wherein the engine is otherwise generally adapted for use with either a horizontal or vertical crankshaft. There further exists a need in the art for such an engine that is adapted to limit or reduce the amount of oil that is conveyed with the blow-by gas into the breather chamber.

SUMMARY OF THE INVENTION

The present invention has been accomplished with such circumstance in view, and it is an object of the present invention to provide a lubricating system for a vertically-oriented crankshaft wherein discharge of the blow-by gas, the separation of oil from the blow-by gas, and the return of oil separated from the blow-by gas to the crankcase can be reliably performed. The present invention is therefore directed toward an improved lubrication system for an engine having a vertically oriented crankshaft wherein the engine is otherwise generally adapted for use with either a horizontal or vertical crankshaft. The present invention is further directed toward such an engine that is adapted to limit or reduce the amount of oil that is conveyed with the blow-by gas into the breather chamber.

In accordance with the present invention, a lubricating and breather system in an engine having a crankcase and a cylinder block adapted for use in either a horizontal-type or vertical-type engine is provided. The engine includes a crankshaft having first and second journal portions. The crankcase has first and second bearing bosses supporting the first and second journal portions of the crankshaft. The second bearing boss lies above the first bearing boss when the engine is of the vertical-type.

In further accordance with the present invention, the lubricating and breather system includes an annular chamber in the second bearing boss for receiving splashed oil produced in the crankcase. A breather chamber, which is in one side of the cylinder block, communicates with the annular chamber to separate blow-by gas and oil. For communication of oil to the crankcase, the breather chamber has a first return bore located at a portion thereof which is a lowermost portion when the engine is a horizontal-type and a second return bore located at a portion thereof which is a lowermost portion when the engine is a vertical-type.

In further accordance with the present invention, a breather tube is coupled to an intake system of the engine and connected to a portion of the breather chamber. The breather tube is located above the first return bore when the engine is a horizontal-type and above the second return bore when the engine is a vertical-type.

In further accordance with the present invention, a cap is secured over the second bearing boss and cooperates with the second bearing boss to define the annular chamber. The cap has a plurality of ribs formed thereon that serve to reduce the amount of oil that is communicated from the annular chamber to the breather chamber. The ribs include a plurality of radially directed ribs and an annular rib.

In further accordance with the present invention, the second bearing boss includes an oil feed hole through which oil and blow-by gases flow from the crankcase to the annular chamber. A plurality of oil return holes, through which oil is returned from the annular chamber to the crankcase, are formed in the second bearing boss. The oil return holes have a smaller diameter than that of the oil feed hole. The second bearing boss further includes a plurality of oil sumps, each of the oil sumps being associated with one of the oil return holes and being adapted to retain an amount of oil therein.

BRIEF DESCRIPTION OF THE DRAWINGS

These and further features of the invention will be apparent with reference to the following description and drawings, wherein:

FIG. 8 is a cross-sectional view through the second bearing boss of the crankcase as seen along line 8—8 of FIG. 3;

FIG. 9 is a partial plan view of an inside surface of a cap; and,

FIG. 10 is a partial cross-sectional view of the cap of FIG. 9.

DETAILED DESCRIPTION OF THE PREFERRED EMBODIMENT

Figure 1:
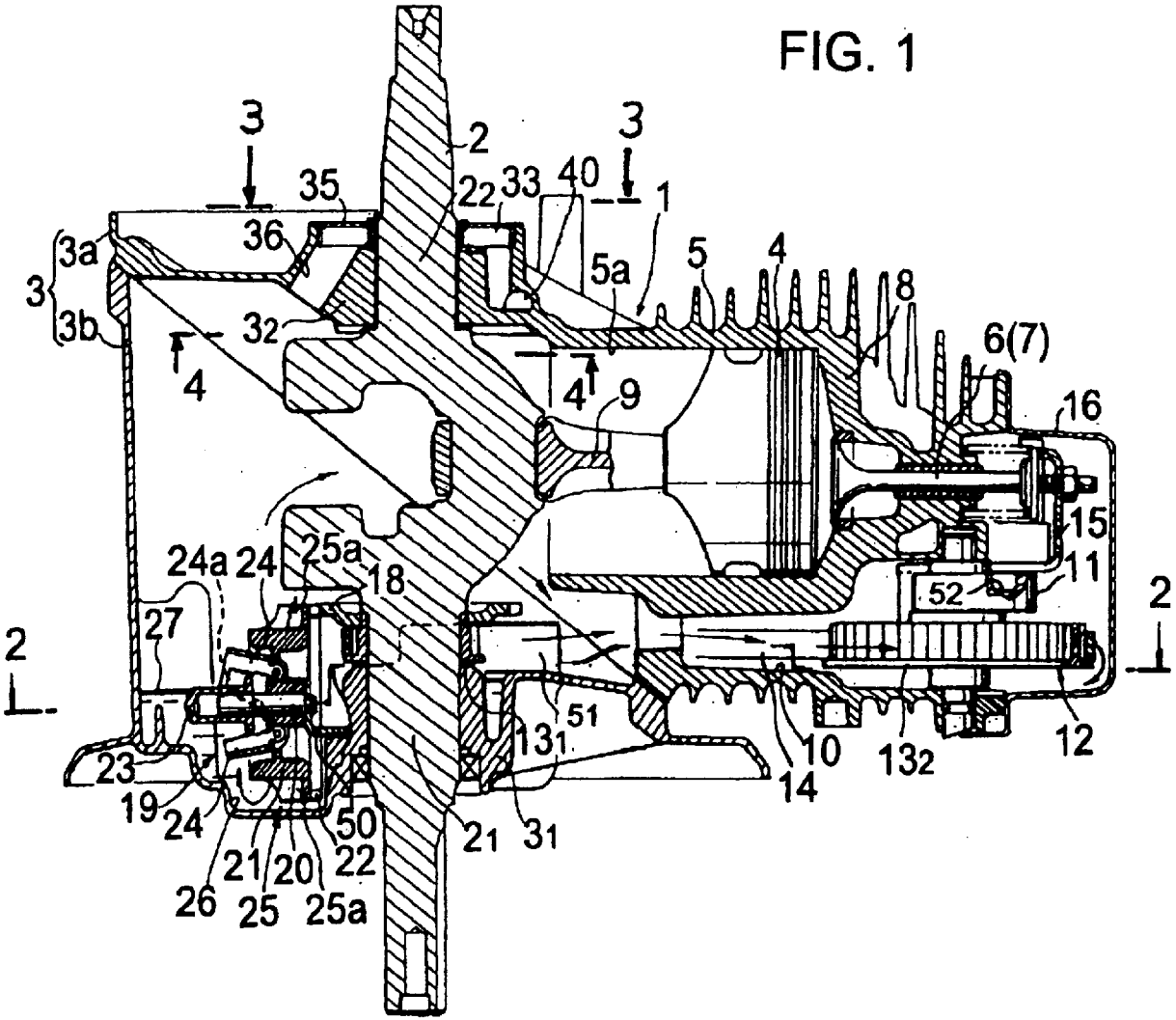
FIG. 1 is a vertical sectional side view of an embodiment of the present invention applied to a vertical-type engine.
Figure 2:
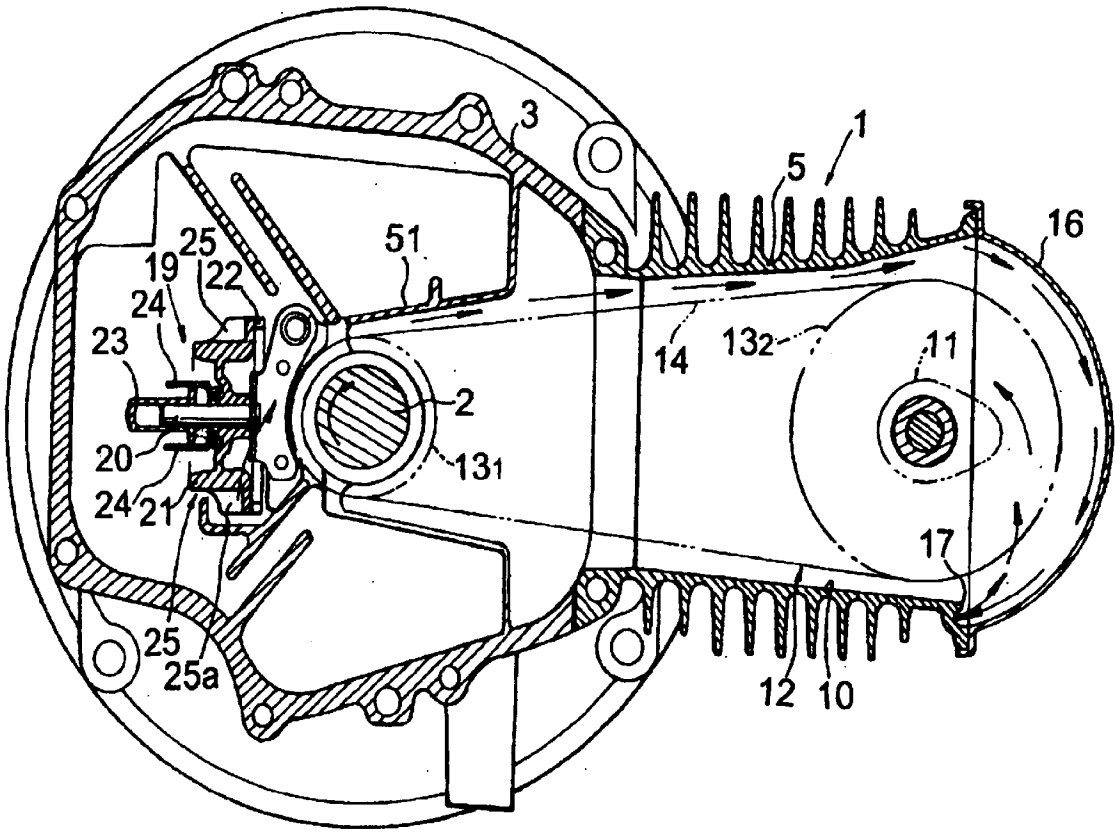
FIG. 2 is a vertical sectional view taken along a line 2—2 in FIG. 1.

Referring to FIGS. 1 and 2, an engine body 1 is comprised of a crankcase 3 that supports a crankshaft 2 disposed vertically. A cylinder block 5 has a cylinder bore 5*a* in which a piston 4 slides, and a cylinder head 8 in which intake and exhaust valves 6 and 7 are supported. The crankshaft 2 and the piston 4 are interconnected by a connecting rod 9. The crankcase 3 is divided into an upper case half 3*a* and a lower case half 3*b* along a diagonal line on the case 3, which obliquely intersects an axis of the crankshaft 2. The upper case half 3*a*, the cylinder block 5, and the cylinder head 8 are integrally formed. In this way, the engine body 1 is formed of two parts and, moreover, is applicable to a vertical-type engine. The upper and lower case halves 3*a* and 3*b* are releasably coupled to each other by one or more bolts.

A flat valve-operating transmitting chamber 10 is defined in one side of the cylinder block 5 adjacent the cylinder bore 5*a*. A timing transmitting device 12 is disposed in the chamber 10 and interconnects the crankshaft 2 and a valve-operating camshaft 11 supported on the cylinder head 8. The timing transmitting device 12 is comprised of a toothed driving pulley $\mathbf{13}_1$ secured to the crankshaft 2, a toothed driven pulley $\mathbf{13}_2$ secured to the valve-operating cam shaft 11, and a toothed belt 14 reeved around both the pulleys $\mathbf{13}_1$ and $\mathbf{13}_2$, so that the rotation of the crankshaft 2 is reduced to one half and transmitted to the valve-operating cam shaft 11. The valve-operating cam shaft 11 is adapted to open and close the intake and exhaust valves 6 and 7 through a rocker arm 15 by the rotation thereof. Portions of the timing transmitting device 12 and the rocker arm 15 are covered by a head cover 16, which is coupled to the cylinder head 8 by bolts.

The engine body 1 is disposed so that the second bearing boss $\mathbf{3}_2$ occupies a position above the first bearing boss $\mathbf{3}_1$, in order to support the crankshaft 2 vertically. An oil reservoir chamber 26, which is a level that is lower than that of the chamber 10, is defined in the lower case half 3*b* of the crankcase 3. The amount of lubricating oil 27 stored in the oil reservoir chamber 26 is set such that the timing transmitting device 12 is not immersed in the oil.

The support shaft 20 of a speed-adjusting centrifugal governor 19 is horizontally secured to a bracket 50 secured to the inner wall of the lower case half 3*b*. The centrifugal governor 19 is formed by the rotary table 21, a tubular slider 23 slidably supported on the support shaft 20, and a plurality of swinging pendulum-type centrifugal weights 24, which are swingably supported on the rotary table 21 to sandwich the slider 23. Each of the centrifugal weights 24 includes an operating arm 24*a* that allows the slider 23 to slide in one direction when the weight 24 is swung radially outwards by centrifugal force. When the slider 23 slides in the one direction, a throttle valve in the intake system is operated to a closed position through a link mechanism (not shown) and the number of revolutions of the engine is controlled to a preset value, in a conventional manner.

A driven gear 22 is formed at an end face of a rotary table 21 rotatably carried on the support shaft 20 and is meshed with a governor driving gear 18 secured to the crankshaft 2. The rotary table 21 has a plurality of vanes 25*a* projecting from an outer peripheral surface thereof to form an impeller 25, and a lower half of the rotary table 21 is immersed in the lubricating oil 27.

A guide wall 51 is integrally formed on an inner wall of the crankcase 3 to cover a path extending from the driving pulley $\mathbf{13}_1$ to the valve-operating transmitting chamber 10 toward the driven pulley $\mathbf{13}_2$. A recess 52, which functions as an oil reservoir, is provided in an upper end face of the valve-operating cam shaft 11.

In the crankshaft 2, a journal portion $\mathbf{2}_1$ on the side of the timing transmitting device 12 is called a first journal portion, and a journal portion $\mathbf{2}_2$ on the opposite side is called a second journal portion. In the crankcase 3, bearing bosses $\mathbf{3}_1$ and $\mathbf{3}_2$ carrying the first and second journal portions $\mathbf{2}_1$ and $\mathbf{2}_2$ are called first and second bearing bosses, respectively. When the engine body 1 is used as a vertical engine, as illustrated, the second bearing boss $\mathbf{3}_2$ lies above the first bearing boss $\mathbf{3}_1$.

Figure 3:
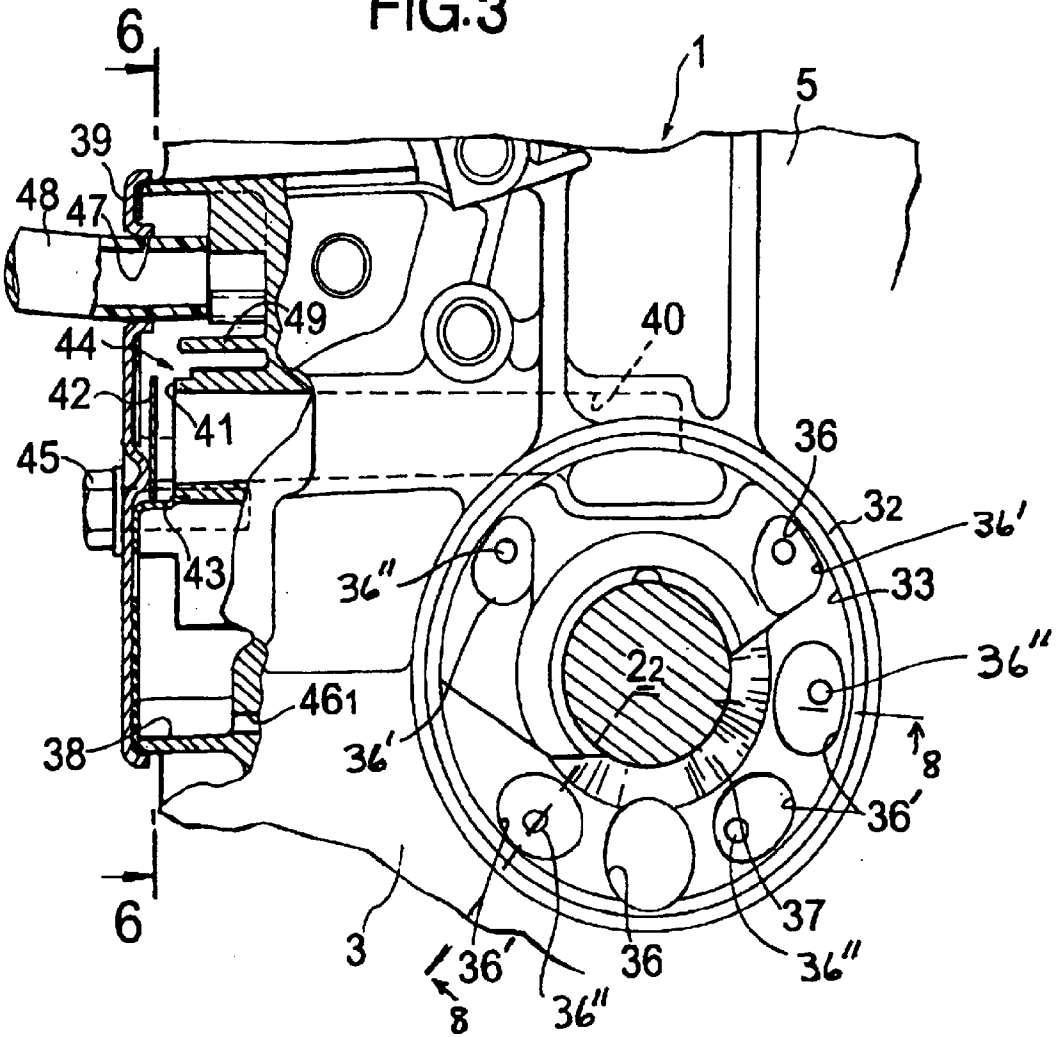
FIG. 3 is a view taken in a direction of an arrow 3—3 in FIG. 1 with the cap for the annular chamber being removed.
Figure 4:
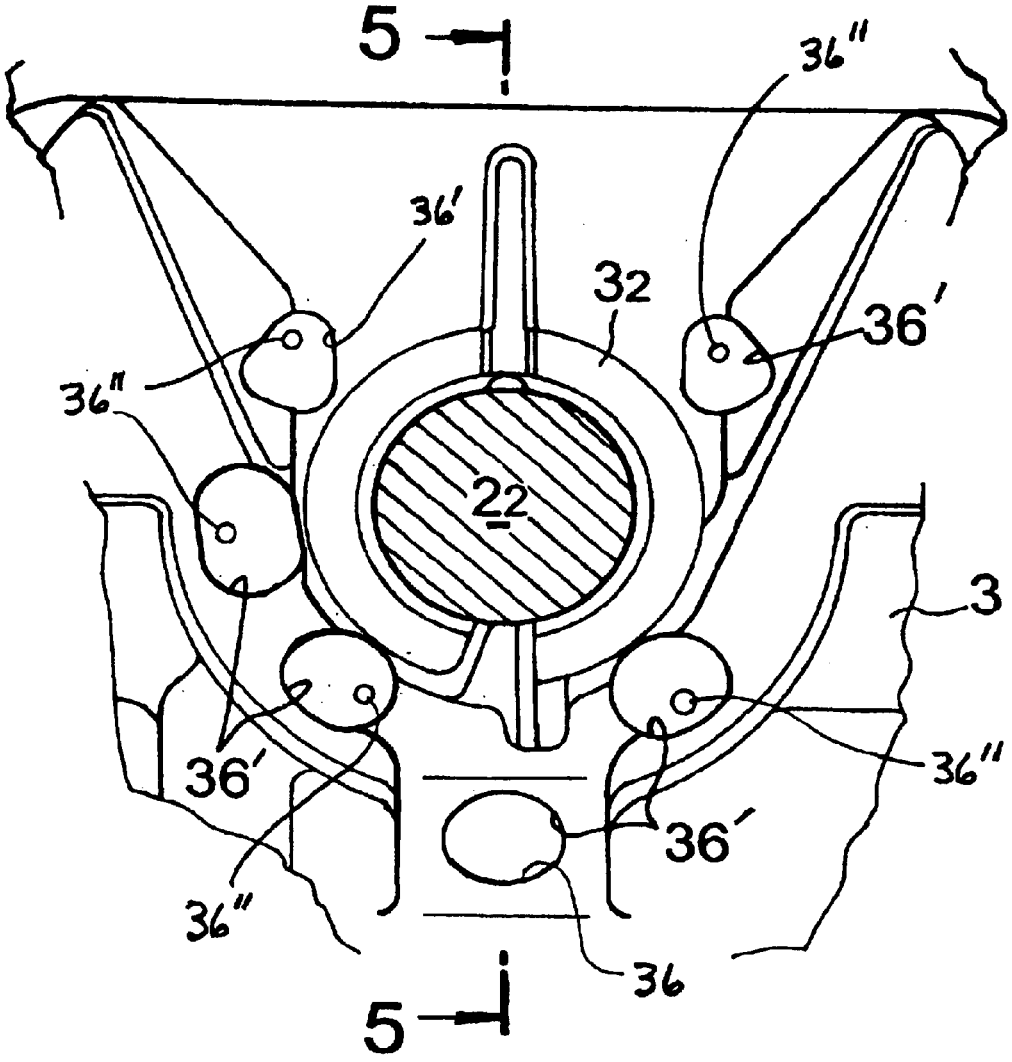
FIG. 4 is a sectional view taken along a line 4—4 in FIG. 1.
Figure 5:
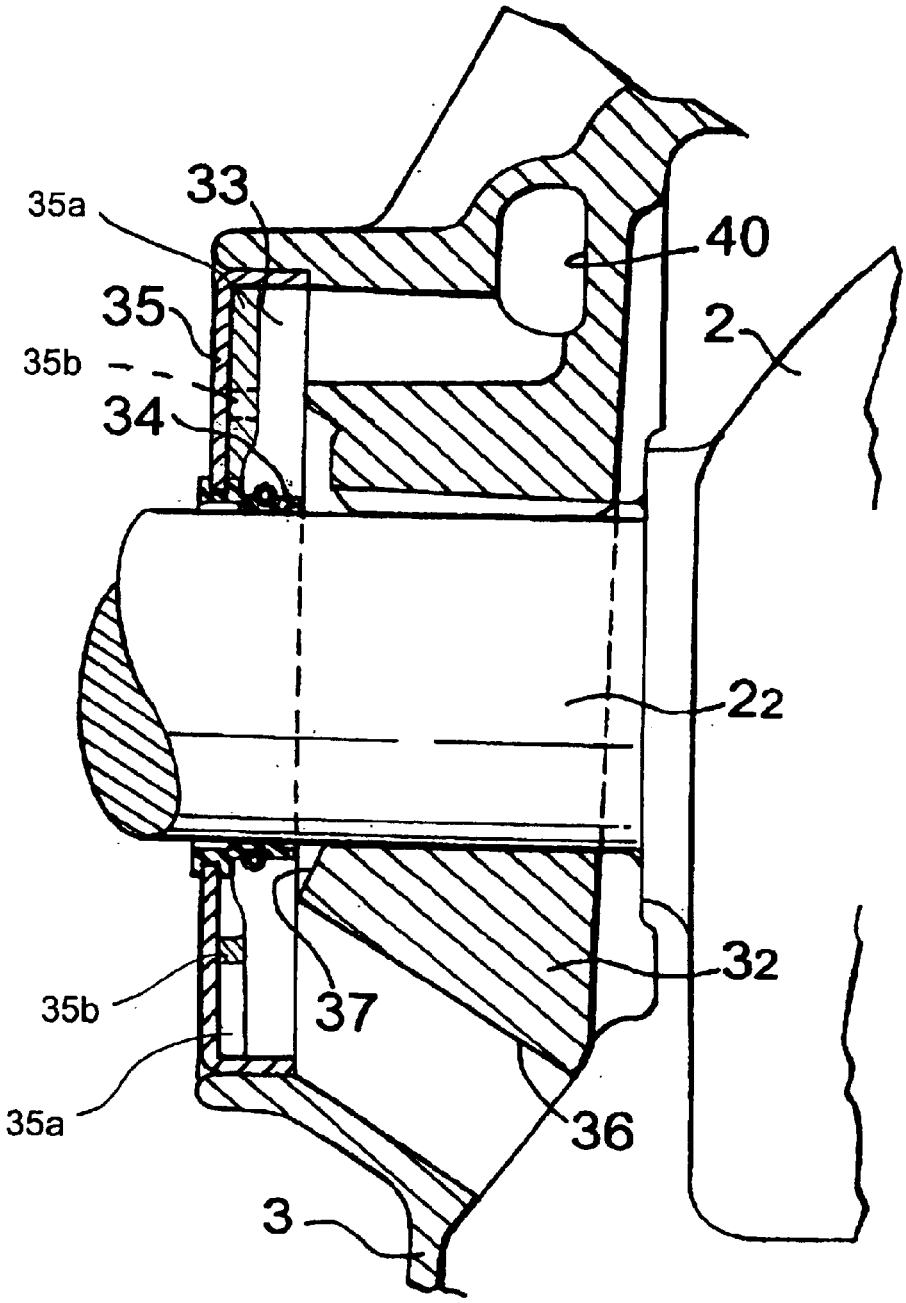
FIG. 5 is a sectional view taken along a line 5—5 in FIG. 4.

In FIGS. 3 to 5, a circular recess 33 is defined in an outer end face of the second bearing boss $\mathbf{3}_2$ of the crankcase 3 and is formed as an annular chamber 33 by closing it with a cap 35. The cap 35, which is preferably formed from metal, carries an oil seal 34 that sealingly engages an outer peripheral surface of the crankshaft 2. The oil seal 34 is surrounded by an annular metal spring 34*a* (FIG. 10), which presses the seal 34 against the crankshaft 2.

The cap 35 preferably has an elastomeric or flexible rubber-like structure molded or otherwise attached thereto. In addition to the oil seal 34, the elastomeric structure includes a plurality of ribs 35*a*, 35*b* formed on an inner surface of the cap 35, as shown best in FIGS. 5 and 9–10. Although the ribs are preferably flexible and integrally formed with the oil seal 34, it is contemplated that the ribs, instead, could be formed from the metal body of the cap 35 by suitable forming operations.

The ribs include a plurality of radially directed ribs 35*a* and an annular rib 35*b*, which is concentric with the crankshaft 2. The annular rib 35*b* is formed by a series of arcuate rib sections that extend between the radially directed ribs 35*a* at a location generally midway along the length of the radially directed ribs 35*a*, as illustrated. The ribs 35*a*, 35*b* present an obstacle to the fluid stream, which consists of blow-by gas and entrained oil, flowing into the annular chamber 33, and thereby permit the entrained oil to fall out of the blow-by gas, as described hereinafter. Naturally, the elastomeric ribs 35*a*, 35*b* and oil seal 34 may be molded over the metal body of the cap 35, or may be attached by suitable adhesive bonding techniques.

With respect to FIGS. 3, 4 and 8, an oil feed hole 36, which permits the annular chamber 33 to communicate with the inside of the crankcase 3, is provided in the second bearing boss $\mathbf{3}_2$. A plurality of oil sumps 36' are also formed in the outer face of the second bearing boss $\mathbf{3}_2$. Each of the oil sumps 36' have an oil return hole 36" formed therein through which oil flows back to the crankcase 3. As will be appreciated, the oil feed hole 36 has a relatively large and, preferably, constant diameter so as to provide free or uninhibited communication between the interior of the crankcase 3 and the annular chamber 33. On the other hand, the oil return holes 36" are substantially smaller in diameter than the oil feed hole 36 and thereby substantially prevent or inhibit the flowing-through of blow-by gas into the annular chamber 33 via the oil return holes 36". Moreover, the oil return holes 36" are sized such that, in use, the oil sumps 36' retain a volume of oil, which further inhibits the flow of blow-by gas through the oil return holes 36".

A cone-shaped oil reservoir 37 is partially or entirely defined in the end face of the second bearing boss $\mathbf{3}_2$ that faces the annular chamber 33. An opening to a breather passage 40, described hereinafter, is preferably formed in the second bearing boss $3_2$ at a location that is radially opposite the oil feed hole 36, as illustrated.

A polygonal recess 38 is defined in one side of the cylinder block 5 and is formed as a breather chamber by closing its opened surface with a lid 39. A breather passage 40, through which the breather chamber 38 communicates with the interior of the crankcase 3, extends from the breather chamber 38 to the annular chamber 33.

Figure 6:
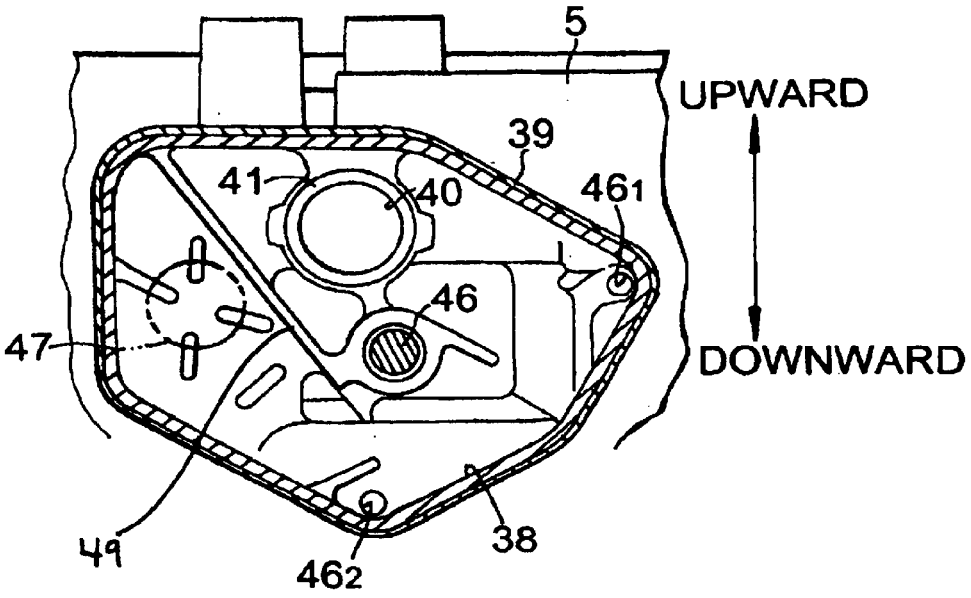
FIG. 6 is a sectional view taken along a line 6—6 in FIG. 3.
Figure 7:
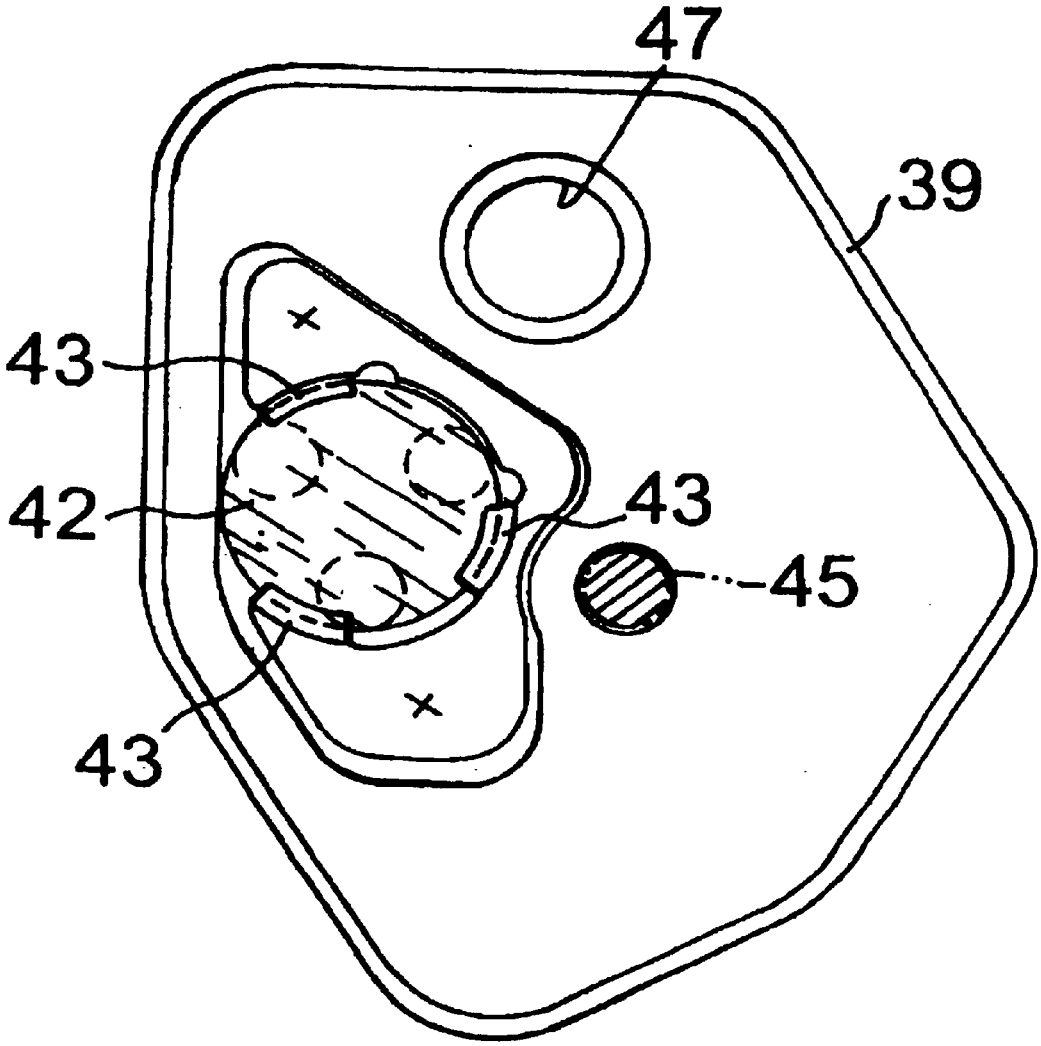
FIG. 7 is an inner side view of a lid for a breather chamber.

As shown in FIGS. 3, 6 and 7, the end face of an opening of the breather passage 40 into the breather chamber 38 is formed on valve seat 41, and a plurality of support pieces 43 are welded to the lid 39 for supporting the valve plate 42 opposed to the valve seat 41 for opening and closing movements. The valve seat 41 and the valve plate 42 form a check valve 44 that is adapted to be opened upon increasing of the pressure in the crankcase 3 and to be closed upon decreasing of the pressure in the crankcase 3. The lid 39 is secured to the cylinder block 5 by a bolt 45.

First and second return bores $46_1$, $46_2$ are formed in the breather chamber 38. The first return bore $46_1$ is provided at a portion which is a lowermost portion when the engine body 1 is a horizontal-type engine while the second return bore $46_2$ is provided at a portion which is a lowermost portion when the engine body 1 is a vertical-type engine. Both of the return bores $46_1$ and $46_2$ lead to the inside of the crankcase 3. Moreover, each of the return bores $46_1$ and $46_2$ have a diameter far smaller than that of the breather passage 40 to inhibit, as much as possible, the flowing-through of the blow-by gas.

A connecting bore 47 is provided in the lid 39 and opens into the breather chamber 38. A breather tube 48 connected to an air cleaner (not shown) in the intake system of the engine is connected to the connecting bore 47. The connecting bore 47 is located above the first return bore $46_1$ when the engine body 1 is applied to a horizontal-type engine, and at a location above the second return bore $46_2$ when the engine body 1 is applied to a vertical-type engine. In the breather chamber 38, a partition wall 49 is integrally formed on the sidewall of the cylinder block 5 to separate the valve seat 41 and the connecting bore 47 from each other.

During rotation of the crankshaft 2, the lubricating oil in the oil reservoir chamber 26 is splashed by the rotation of the impeller 25. A portion of the splashed oil is guided by the guide wall 51 in the vicinity of the impeller 25, toward the chamber 10 and lubricates the timing transmitting device 12, the other valve-operating mechanism elements, and the first journal portion $2_1$. The other portion of the splashed oil passes through the oil feed hole 36 in the second bearing boss $3_2$ into the annular chamber 33. Simultaneously, the pressure in the crankcase 3 is repeatedly increased and decreased with the reciprocating movement of the piston 4. When the pressure in the crankcase 3 is increased, the check valve 44 is opened, so that the pressure is transferred along with the blow-by gas via the annular chamber 33 and the breather passage 40 into the breather chamber 38. When the pressure in the crankcase 3 is decreased, the check valve 44 is closed, whereby the back flow of the blow-by gas is prevented.

Upon entering the annular chamber, the fluid stream (blow-by gas and oil) confronts the ribs 35*a*, 35*b* extending from the inner surface of the cap 35, which causes the velocity of the fluid stream to slow and thereby allows at least some of the oil entrained in the fluid stream to drop out of the blow-by gas. Accordingly, the amount of oil that is entrained in the blow-by gas that enters the breather passage 40 and, ultimately, the breather chamber 38 is reduced. The splashed oil is accumulated in the cone-shaped oil reservoir 37 in the upper surface of the second bearing boss $3_2$ and can effectively lubricate the second journal portion $2_2$ at a location above the first journal portion $2_1$. Further, splashed oil is accumulated in the oil sumps 36', and slowly drains back into the crankcase via the oil return holes 36". The diameter of the oil return holes 36" is preferably selected to provide sufficient drainage flow to prevent the sumps 36' from overflowing, while retaining a small volume of oil in the sumps 36'. The small diameter of the oil return holes 36" coupled with the oil retained in the sumps 36' serves to prevent or limit blow-by gas from entering the annular chamber 33 through the oil return holes 36".

Blow-by gas produced in the crankcase 3 is passed via the annular chamber 33 (wherein a first portion of the oil entrained in the blow-by gas is removed) and the breather passage 40 into the breather chamber 38. The fluid stream (blow-by gas and oil (reduced)) enters the breather chamber 38 and traverses the partition wall 49, which causes further oil to fall out of the blow-by gas. This further oil drains from the breather chamber 38 to the crankcase 3 via the second return bore $46_2$. The blow-by gas, now substantially free of oil, is guided through the breather tube 48 to the air cleaner (not shown) and discharged.

After stopping of the engine, the oil droplets are accumulated in the recess 52 in the upper end face of the valve-operating camshaft 11 from above the recess 52. Upon restart of the engine, such oil is shaken off by the rotation of the valve-operating cam shaft 11 and is used in the lubrication of the valve-operating mechanism elements around the valve-operating cam shaft 11. Therefore, particularly even upon the start of the engine which has hitherto been in its stopped state, the valve-operating mechanism can be prevented from being out of oil.

Although the embodiment of the present invention has been described in detail, it will be understood that the present invention is not limited to the above-described embodiment, and various modifications in design may be made without departing from the spirit and scope of the invention defined in claims.

What is claimed is:

1. A lubricating and breather system in an engine having a crankcase and a cylinder block adapted for use in either a horizontal-type or vertical-type engine, and a crankshaft having first and second journal portions, the crankcase having first and second bearing bosses supporting the first and second journal portions of the crankshaft, wherein the first and second bearing bosses are positioned such that the second bearing boss lies above the first bearing boss when the engine is of the vertical-type, wherein:

the lubricating and breather system comprises an annular chamber in the second bearing boss for receiving splashed oil produced in the crankcase;

a breather chamber which is in one side of the cylinder block communicating with the annular chamber to separate gas and liquid, the breather chamber having a first return bore located at a portion thereof which is a lowermost portion when the engine is a horizontal-type, for communicating with the inside of the crankcase, and a second return bore located at a portion thereof which is a lowermost portion when the engine is a vertical-type, for communicating with the inside of the crankcase; and a breather tube adapted to be operatively coupled to an intake system of the engine and connected to a portion of the breather chamber, said breather chamber being located above the first return bore when the engine is a horizontal-type and above the second return bore when the engine is a vertical-type;

the improvement comprising:

a cap secured over the second bearing boss and cooperating with the bearing boss to define the annular chamber, said cap having a plurality of ribs formed thereon that serve to reduce an amount of the liquid, which is entrained in the gas, that is communicated from said annular chamber to said breather chamber.

2. The lubricating and breather system according to claim 1, wherein the second bearing boss includes an oil feed hole through which gas and liquid are introduced from the crankcase into the annular chamber, and a plurality of oil return holes through which oil is returned from the annular chamber to the crankcase, said oil return holes having a smaller diameter than a diameter of said oil feed hole.

3. The lubricating and breather system according to claim 2, wherein said second bearing boss further includes a plurality of oil sumps, each of said oil sumps being associated with one of said oil return holes and being adapted to retain an amount of oil therein.

4. The lubricating and breather system according to claim 1, wherein said ribs include a plurality of radial ribs and an annular rib.

5. The lubricating and breather system according to claim 4, wherein the second bearing boss includes an oil feed hole through which gas and liquid are introduced from the crankcase into the annular chamber, and a plurality of oil return holes through which oil is returned from the annular chamber to the crankcase, said oil return holes having a smaller diameter than a diameter of said oil feed hole.

6. The lubricating and breather system according to claim 5, wherein said second bearing boss further includes a plurality of oil sumps, each of said oil sumps being associated with one of said oil return holes and being adapted to retain an amount of oil therein.

7. The lubricating and breather system according to claim 2, further comprising a breather passage extending between said breather chamber and said annular chamber, and wherein an inlet to said breather passage is formed in said second bearing boss at a location that is radially opposite to a location of said oil feed hole.

8. The lubricating and breather system according to claim 7, wherein said ribs include a plurality of radial ribs and an annular rib.

9. The lubricating and breather system according to claim 8, wherein the second bearing boss includes an oil feed hole through which gas and liquid are introduced from the crankcase into the annular chamber, and a plurality of oil return holes through which oil is returned from the annular chamber to the crankcase, said oil return holes having a smaller diameter than a diameter of said oil feed hole.

10. The lubricating and breather system according to claim 9, wherein said second bearing boss further includes a plurality of oil sumps, each of said oil sumps being associated with one of said oil return holes and being adapted to retain an amount of oil therein.

11. A cap that is disposed around an upper end of a crankshaft on an engine having a vertically-oriented crankshaft, said cap being generally annular and cooperating with a bearing boss supporting the crankshaft upper end to define an annular chamber, said annular chamber being adapted to receive blow-by gas from a crankcase of the engine, said cap including:

an annular metal body;

an oil seal extending from said annular metal body and adapted to sealingly engage the crankshaft;

a plurality of ribs formed on an inner surface of said annular metal body, said ribs serving to disrupt flow of a fluid stream introduced into the annular chamber so as to permit oil entrained in the fluid stream to be removed therefrom.

12. The cap according to claim 11, wherein said ribs include a plurality of radial ribs and at least one annular rib.

13. A bearing boss for a vertically-oriented crankshaft on an engine, said bearing boss being disposed relatively above a crankcase of the engine and being adapted to rotatably support an upper end of the crankshaft, said bearing boss including:

an oil feed hole having a first diameter and through which a fluid stream is introduced from the crankcase into an annular chamber disposed on an outer side of said bearing boss;

a plurality of oil return holes having a second diameter and through which oil flows from said outer side of said bearing boss to the crankcase, wherein said second diameter is smaller than said first diameter.

14. The bearing boss according to claim 13, further comprising a plurality of oil sumps, each of said oil sumps being associated with one of said oil return holes and being adapted to retain an amount of oil therein.

15. The bearing boss according to claim 14, wherein an inlet to a breather passage is formed in said bearing boss at a location that is radially opposite to a location of said oil feed hole.

* * * * *

UNITED STATES PATENT AND TRADEMARK OFFICE

CERTIFICATE OF CORRECTION

PATENT NO. : 6,827,068 B1
DATED : December 7, 2004
INVENTOR(S) : Sakata et al.

It is certified that error appears in the above-identified patent and that said Letters Patent is hereby corrected as shown below:

Title page,
Item [60], Related U.S. Application Data, delete "60/507,570" and insert -- 60/507,870 --.

Signed and Sealed this

Twelfth Day of April, 2005

JON W. DUDAS
*Director of the United States Patent and Trademark Office*